US011202965B2

(12) United States Patent
Brown et al.

(10) Patent No.: US 11,202,965 B2
(45) Date of Patent: Dec. 21, 2021

(54) WATER EFFECT PLAY UNITS AND STRUCTURES

(71) Applicant: THE FOUNTAIN PEOPLE, INC., San Marcos, TX (US)

(72) Inventors: Kevin Brown, Mountain City, TX (US); Chris Thomas, Wimberley, TX (US); Luke Cavanaugh, New Braunfels, TX (US); Matthew Dangle, Gadsden, AL (US); Thomas Robert Norquist, Fort Payne, AL (US)

(73) Assignee: THE FOUNTAIN PEOPLE, INC., San Marcos, TX (US)

( * ) Notice: Subject to any disclaimer, the term of this patent is extended or adjusted under 35 U.S.C. 154(b) by 242 days.

(21) Appl. No.: 16/153,078

(22) Filed: Oct. 5, 2018

(65) Prior Publication Data

US 2019/0105575 A1 Apr. 11, 2019

Related U.S. Application Data

(60) Provisional application No. 62/569,259, filed on Oct. 6, 2017.

(51) Int. Cl.
*A63G 31/00* (2006.01)
*A63H 23/10* (2006.01)

(52) U.S. Cl.
CPC ..... *A63G 31/007* (2013.01); *A63H 23/10* (2013.01); *A63F 2250/0421* (2013.01)

(58) Field of Classification Search
CPC ..... A63G 31/007; A63H 23/10; A63H 23/16; E04H 4/14; E04H 4/0025; A63F 2250/0407; A63F 2250/0421
USPC ..... 446/153
See application file for complete search history.

(56) References Cited

U.S. PATENT DOCUMENTS 1,493,885 A * 5/1924 Lambert ..... A47G 19/12 222/482
4,093,228 A * 6/1978 Pierce ..... A63B 63/00 273/384
4,655,373 A * 4/1987 Essen ..... A47G 19/12 220/835
4,778,429 A * 10/1988 Todokoro ..... A63H 23/00 446/153
5,194,048 A * 3/1993 Briggs ..... A63G 31/007 472/128
5,336,122 A * 8/1994 Lewis ..... A63H 23/16 446/153

(Continued)

*Primary Examiner* — Eugene L Kim
*Assistant Examiner* — Alyssa M Hylinski
(74) *Attorney, Agent, or Firm* — McAndrews, Held & Malloy, Ltd.

(57) ABSTRACT

Embodiments of the present disclosure relate to water effect play structures for use in playgrounds, splash pads, and water parks. The play structures comprise a plurality of water tanks maintained at an elevation above a play surface. Each of the plurality of water tanks fills with water and then releases the water contained therein, splashing children in the vicinity. Each of the plurality of water tanks may be configured to release the water contained therein at different times. Further, in some embodiments, the water tanks may be enclosed, such as by being connected to a water transport system that fills the tanks internally and by having a movable cover over the opening(s) through which the water is released.

18 Claims, 7 Drawing Sheets

(56) References Cited

U.S. PATENT DOCUMENTS 5,405,294 A * 4/1995 Briggs ..... A63G 31/007 472/128
5,634,642 A * 6/1997 Grandolfo ..... A63B 63/00 473/423
5,662,525 A * 9/1997 Briggs ..... A63B 9/00 472/128
5,820,471 A * 10/1998 Briggs ..... A63G 31/007 472/128
5,839,964 A * 11/1998 Rudell ..... A63B 9/00 472/117
5,839,981 A * 11/1998 Rudell ..... A63B 63/083 473/480
5,848,793 A * 12/1998 Celis ..... F41J 7/04 273/384
6,012,960 A * 1/2000 Lee ..... A63H 23/10 446/180
6,206,251 B1 * 3/2001 Williams ..... B65D 47/2018 222/479
6,527,646 B1 * 3/2003 Briggs ..... A63G 21/18 104/69
7,017,768 B2 * 3/2006 Iskierka ..... A47G 19/2211 116/207
7,285,053 B2 * 10/2007 Henry ..... A63G 3/02 472/117
7,316,400 B1 * 1/2008 Holsten ..... A63B 67/00 273/440
7,572,191 B2 * 8/2009 Weston ..... A63G 3/00 273/109
7,758,435 B2 * 7/2010 Henry ..... A63G 3/00 472/128
7,942,852 B2 * 5/2011 Mas ..... A61B 17/22 604/119
7,946,307 B2 * 5/2011 Zheng ..... E04H 15/40 135/126
7,980,914 B1 * 7/2011 Blais ..... A63G 31/007 4/488
8,074,305 B2 * 12/2011 Matsuda ..... A61Q 19/10 4/559
8,075,413 B2 * 12/2011 Henry ..... A63G 3/02 472/117
8,096,892 B2 * 1/2012 Henry ..... A63J 17/00 472/128
8,205,293 B2 * 6/2012 Rosenzweig ..... F04B 5/02 15/320
8,226,493 B2 * 7/2012 Briggs ..... A63G 33/00 472/128
8,336,884 B1 * 12/2012 Pierce ..... F41J 5/24 273/384
8,500,510 B2 * 8/2013 Nuttall ..... A63H 18/028 446/153
8,721,465 B2 * 5/2014 Hunter ..... F16K 21/18 472/117
8,753,216 B2 * 6/2014 Hsieh ..... A63G 31/007 472/128
9,483,961 B1 * 11/2016 Alayoub ..... G09B 25/08
9,517,420 B2 * 12/2016 White ..... A63G 31/007
9,656,180 B2 * 5/2017 Burger ..... A63G 31/007
9,884,260 B2 * 2/2018 Weisman ..... A63H 23/16
10,166,484 B1 * 1/2019 Chen ..... A63G 31/007
D850,018 S * 5/2019 Paxson ..... D30/132
10,279,358 B2 * 5/2019 Pickens, Jr. ..... B05B 1/205
10,343,078 B2 * 7/2019 Weisman ..... A63H 23/10
D865,073 S * 10/2019 Weisman ..... D21/473
10,586,388 B2 * 3/2020 Graham ..... A61C 13/0004
2009/0095766 A1 * 4/2009 Trainello ..... B65D 51/10 220/810
2011/0167556 A1 * 7/2011 Irwin ..... E03C 1/0407 4/605
2012/0214382 A1 * 8/2012 Ochi ..... A63G 31/007 446/153
2014/0094086 A1 * 4/2014 Hamelin ..... A63H 23/10 446/153
2014/0151390 A1 * 6/2014 Kohler ..... A47G 19/12 220/825
2014/0265134 A1 * 9/2014 Cello ..... A63F 9/02 273/384

* cited by examiner

WATER EFFECT PLAY UNITS AND STRUCTURES

The present application claims priority to U.S. Provisional Patent Application No. 62/569,259, filed on Oct. 6, 2017, the entirety of which is incorporated by reference herein.

BACKGROUND

Among the most popular play structures at water parks and playgrounds or splash pads are those that provide a big splash effect, such as the Tidal Bucket™ by Water Odyssey™. These "big splash" structures fill with water and then unexpectedly release their contents onto children and/or adults standing underneath them. Children especially love the anticipation and the surprise of having a large quantity of water splash on themselves and/or their friends, siblings, parents, etc.

It has presently been recognized, however, that children soon realize that after a "big slash" has occurred, there is a period of inactivity while the structure refills with water. Accordingly, children move on to other play opportunities and return only when it appears that another "big splash" is either about to occur or is occurring. Moreover, because the top of the bucket on a "big splash" structure is typically open to the environment, it has presently been recognized that some children attempt (and sometimes succeed) to throw a variety of objects into the bucket. This can both result in dangerous situations and, when successful, cause the unit to function improperly. Similarly, environmental debris, such as leaves and/or branches of nearby trees, or animals, such as birds or insects, may land in the bucket.

Embodiments of the present invention are directed toward an improved "big splash" structure that, among other improvements, is designed to keep children's attention for an extended duration and to prevent objects from entering into the open buckets.

SUMMARY OF THE INVENTION

Embodiments of the present disclosure relate to water effect play structures for use in playgrounds and water parks. The play structures comprise a base designed to maintain a plurality of water tanks at an elevation above a play surface. The base may comprise one or more support posts. A first, bottom end of the support post(s) is configured to be mounted to a play surface. The play structure also comprises a water transport system that is configured to transport water from a water supply to the plurality of water tanks.

Each of the plurality of water tanks fills with water and then releases the water contained therein so that the water falls toward the play surface and splashes children in the vicinity of the water tank. Notably, each of the plurality of water tanks may be configured to release the water contained therein at different times. In this way, children will not know when each of the plurality of water tanks is going to provide a splash effect, causing children to navigate between the water tanks as each tank releases its contents. This will both keep a child's attention for a relatively long period of time by preventing downtime and cause a child to exercise as they move from water tank to water tank. Moreover, the predicting of which water tank will be next to release its contents provides an extra social play feature.

In some embodiments, the water transport system may include a component that extends into an interior of at least one of the plurality of water tanks, and preferably each of the plurality of water tanks so that the water tanks may be filled internally. This facilitates the interior of the water tanks being inaccessible to objects that could be thrown by children. For instance, the opening or openings in the water tank through which water flows out of the tank may be sized and configured to prevent outside objects from entering the interior of the water tank without limiting or slowing the process by which the tank is filled. In some embodiments, the water tank may comprise a cover for the opening or openings, the cover being configured to open, e.g. by swinging away from the water tank, when the tank releases its contents.

In some embodiments, one or more of the water tanks may comprise a first end and a second end. The one or more openings through which the water flows out of the tank may be located on the first end of the tank. The tank is configured to rotate between a first position, also known as a filling position, and a second position, also known as a releasing position. In the first position, the first end of the water tank faces substantially upward and the tank is filled with water by the water transport system. In the second position, the first end of the water tank faces substantially downward and the tank releases the water contained therein through the one or more openings.

In some embodiments, one or more of the water tanks may be configured so that filling of the tank to a threshold volume of water causes the tank to rotate from the first position into the second position. For example, the second end of the water tank may have a greater weight than the first end, such that the empty (or substantially empty) tank is biased into the first, filling position. In the first position, the first end of the water tank may be positioned angularly above the second end. Therefore, as the volume of water contained in the tank increases, a point is reached in which the weight of the water in or near the first end of the tank may exceed that of the second end, causing the water tank to rotate, or flip, from the first position to the second position. In some embodiments, for instance, the first end of the water tank may have a greater internal volume than the second end of the tank.

In some embodiments, at least a first water tank and a second water tank may be configured to flip from the first position to the second position at different times by having the activating volume of water (i.e. the volume of water at which the tank flips from the first position to the second position) differ between the tanks. For instance, the activating volume for a first water tank may be greater than or less than the activating volume for a second water tank. In other embodiments, at least a first water tank and a second water tank may be configured to flip from the first position to the second position at different times by having the rate of filling of the tanks differ. For instance, the rate at which a first water tank fills may be greater than or less than the rate at which a second water tank fills. In yet other embodiments, both the activating volumes and the fill rates of at least a first tank and a second tank may differ.

In some embodiments, the water released from one or more of the water tanks may be deflected and manipulated by a deflector before reaching the play surface. For instance, the structure may comprise a plurality of deflectors, with each deflector being positioned below one or more of the plurality of water tanks. This allows the water released from the tank to be manipulated to bring about any of a number of splash effects. In some embodiments, the deflectors may comprise different surface geometries configured to provide a variety of different splash effects. For instance, the surface geometry of a first deflector may differ from the surface geometry of a second deflector such that the flow of water from the first deflector differs from the flow of water from the second deflector.

The plurality of water tanks and, if present deflectors, may be arranged in a number of configurations. In some embodiments, the plurality of water tanks may be arranged in a closed circuit. For example, the plurality of water tanks may be arranged to form a polygon. In some embodiments, for example, a play structure may comprise four water tanks arranged to form a square (with one tank on each side). In some embodiments, the water released from the four water tanks may be directed, such as by use of deflectors, away from the center of the polygon, thereby creating a dry zone directly below the center of the structure. In other embodiments, the plurality of water tanks may be arranged in series, such as to form a line, a zig-zag, or a circular arc.

In another aspect, embodiments of the present disclosure also relate to a water effect play unit comprising first and second support posts, a crossbar, one or more water tanks, and a water transport system. The first and second support posts each have a lower portion that is configured to be mounted to a play surface and an upper portion. The crossbar spans between the first and second support posts, having a first end connected to an upper portion of the first support post and a second end connected to an upper portion of the second support post. The one or more water tanks are positioned on the crossbar, for instance such that the crossbar runs through the water tank. The water transport system is configured to transport water to the water tank. For instance, the water transport system may comprise piping that runs through at least one of the first and second support posts and through at least a portion of the crossbar. In some embodiments, the water transport system may comprise piping that runs through both the first and second support posts and fully through the crossbar. In this way, the water transport system may be fully concealed within (and protected by) the support post(s) and the crossbar.

Each of the one or more water tanks comprises a first end and a second end. The first end of the water tank comprises one or more openings to the interior of the tank. The water tank may be biased into a filling position in which the first end of the water tank is disposed angularly above the second end. For example, the second end of the water tank may comprise one or more weighted portions that bias the water tank into the filling position. Upon filling of the water tank with a threshold, or activating, volume of water, the tank is configured to rotate, or flip, from the filling position to a releasing position. In the releasing position, the first end of the water tank is located below the second end, such that the water contained within the tank flows through the one or more openings.

In some embodiments, the one or more openings in the water tank may be sized and configured to prevent objects from entering the interior of the tank. For example, the opening may comprise a narrow slit. In some embodiments, the water tank may also comprise a cover for the one or more openings. The cover may be configured to cover the one or more openings when the water tank is in the filling position, thus preventing objects from entering the interior of the tank. When the water tank rotates into the releasing position, gravity and/or the water flowing through the one or more openings may cause the cover to swing open to allow water to flow out of the interior of the water tank. When the water tank rotates back into the filling position, the cover may swing back into a closed position, wherein it rests on top of the one or more openings.

In some embodiments, the play unit may also comprise a deflector positioned below the water tank. The deflector may be positioned to deflect and manipulate the water released from the one or more water tanks on its path toward the play surface. In this way, a particular splash effect may be created. The deflector may be configured to direct water exiting the water tank in one or more directions. For example, in some embodiments, the deflector may be angled or curved so as to direct the water in a substantially single direction. The deflector may also comprise a top surface having one or more features, e.g. concave or convex features, configured to manipulate the water to provide a particular splash effect. For example, the deflector may comprise one or more protrusions, such as teeth or bumps, to disrupt the flow of water. In some embodiments, the deflector may be mounted on another crossbar spanning between the first support post and the second support post.

In some embodiments, the play unit may be modular. In other words, each play unit may be configured so that a plurality of the units may be linked together to form a water effect play structure. For instance, in some embodiments, the water effect play unit may also comprise a third support post, a second crossbar, and a second water tank (or tanks) positioned on the second crossbar. The third support post may also be configured to be mounted in the play surface, such as at a location adjacent to the second support post. The second crossbar may be configured to span between the second support post and the third support post. For instance, a first end of the second crossbar may be connected to an upper portion of the second support post and a second end of the second crossbar may be connected to an upper portion of the third support post. The second crossbar may extend through the second water tank (or tanks). The water transport system may be configured to fill both the first water tank and the second water tank. For example, in some embodiments, the water transport system may comprise piping that runs through and links the first crossbar and the second crossbar. In other embodiments, the water transport system may be configured to fill each water tank independently, such that the flow of water to a second water tank is distinct from the flow of water to a first water tank.

In this way, a desired number of play units may be connected together to form water effect play structures having a variety of configurations. For instance, a third play unit having a third crossbar and its associated water tank may be connected between the third support post and a fourth support post, a play unit having a fourth crossbar and associated water tank may be connected between the fourth support post and a fifth support post, and so on. In some embodiments, the plurality of water effect units may be connected in a closed circuit, such as to form a circular or polygonal play structure. In other embodiments, the plurality of water effect units may be connected in series, such as in a line, a zig-zag, a circular arc, etc.

BRIEF DESCRIPTION OF THE DRAWINGS

A clear conception of the advantages and features of one or more embodiments will become more readily apparent by reference to the exemplary, and therefore non-limiting, embodiments illustrated in the drawings.

DETAILED DESCRIPTION OF THE INVENTION

Figure 1:
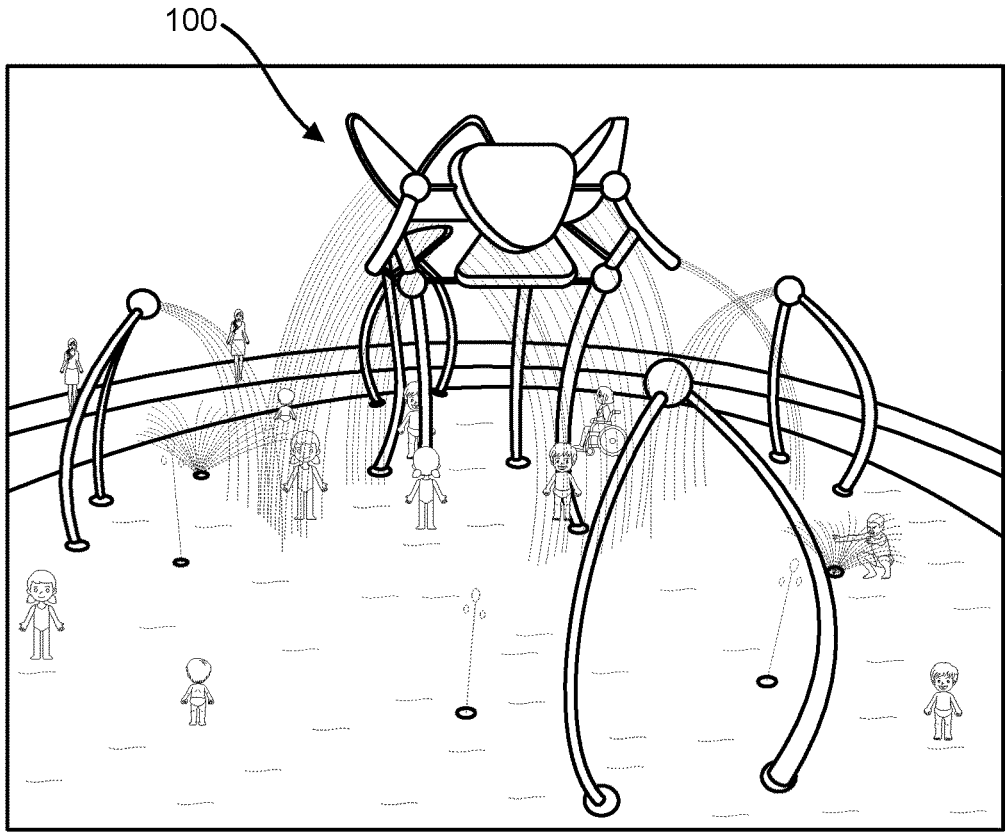
FIG. 1 is a perspective view of an embodiment of a water effect play structure of the present disclosure.
Figure 2:
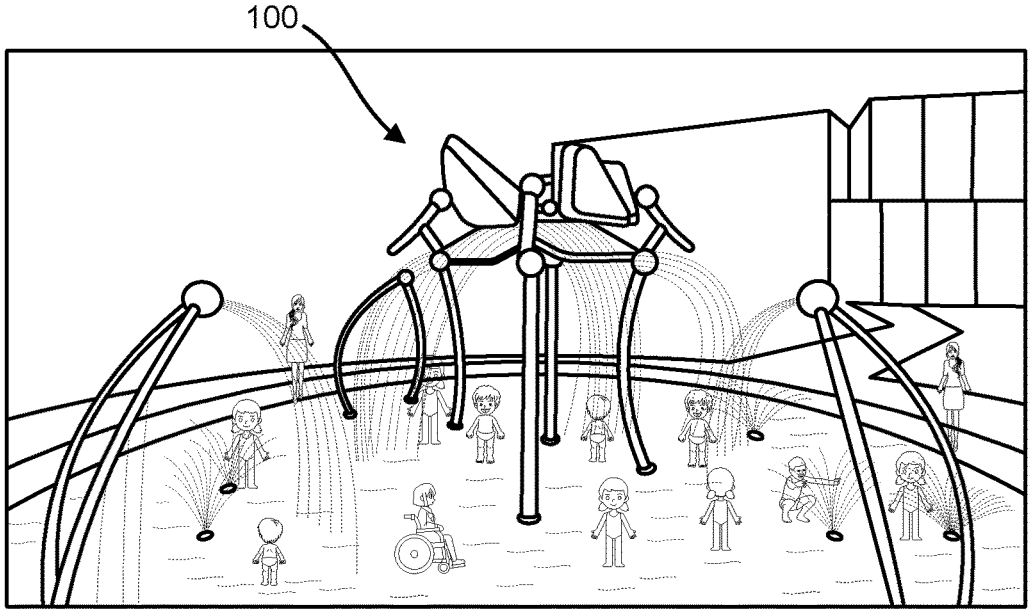
FIG. 2 is a perspective view of an embodiment of a water effect play structure of the present disclosure.

As can be seen in FIGS. 1 and 2, embodiments of the water effect play structures 100 described herein can form the centerpiece of a water play feature. In some embodiments, the water effect play structure 100 may be comprised of a plurality of modular water effect play units 10 assembled together. However, it is also contemplated that the play structures 100 described herein can take on any number of different structural configurations and need not be comprised of the water effect play units 10 of the present disclosure.

Figure 3:
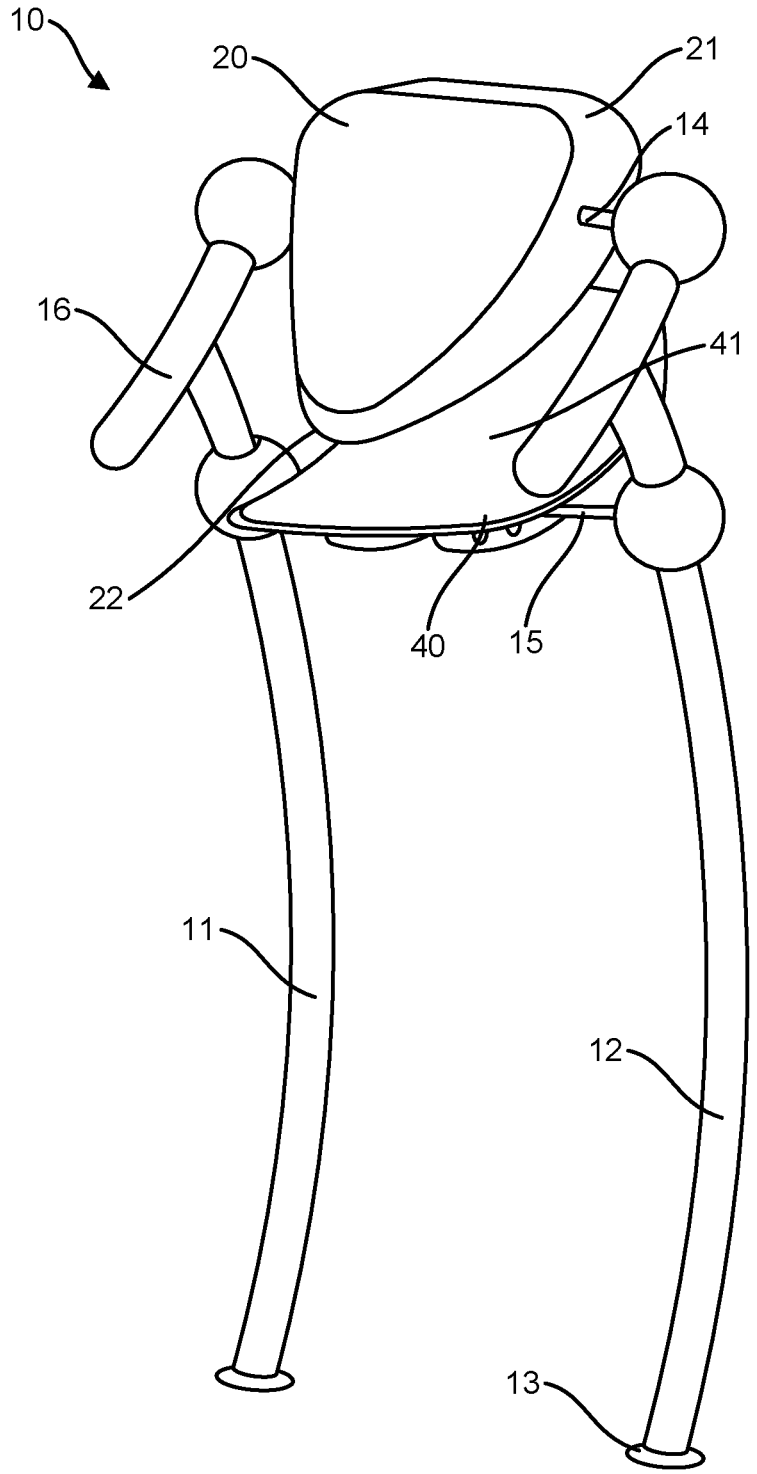
FIG. 3 is a front, right perspective view of an embodiment of a water effect play unit of the present disclosure.

An embodiment of a water effect play unit 10 is shown in FIG. 3. The water effect play unit 10 comprises a first support post 11 and a second support post 12. In the illustrated embodiment, each of the first and second support posts 11, 12 are curved. In other embodiments, each of the first and second support posts 11, 12 may take on other configurations. For example, in some embodiments, each of the first and second support posts 11, 12 may be straight or substantially straight. The lower portion 13 of each of the first and second support posts 11, 12 is configured to be mounted to a play surface. For example, in some embodiments, the lower portion 13 of the support posts 11, 12 may be configured to be bolted into a play surface, such as through a peripheral flange. In other embodiments, the lower portion 13 of the support posts 11, 12 may be configured to be anchored into the ground beneath the play surface.

The play unit 10 may also comprise one or more crossbars 14. As illustrated in FIG. 3, the crossbar 14 may span between the upper portions of the first and second support posts 11, 12. For instance, the crossbar 14 may have a first end that is connected to an upper portion of the first support post 11 and a second end that is connected to an upper portion of the second support post 12. In some embodiments, the crossbar 14 may be rotatably connected to the first and second support posts 11, 12. In the illustrated embodiment, the crossbar 14 is shown as being positioned at the very top of the first and second support posts 11, 12. In other embodiments, however, one or both of the first and second support posts 11, 12 may continue to a higher elevation, from which one or more play features or aesthetic (e.g. themed) features may be mounted.

In some, non-illustrated embodiments, a play unit 10 may comprise more than one crossbar 14. For instance, in some embodiments, a play unit 10 may comprise multiple crossbars 14 positioned at different locations along the support posts 11, 12, i.e. at different vertical heights. For example, a second crossbar 14 may be positioned vertically below a first crossbar 14. A play unit 10 may also comprise multiple crossbars 14 positioned at substantially the same location along the support posts 11, 12, i.e. at substantially the same vertical height. For example, a second crossbar 14 may be positioned horizontally adjacent to a first crossbar, depending on the width/thickness of the support posts 11, 12.

The play unit 10 also comprises one or more water tanks 20. As illustrated in FIG. 3, each of the one or more water tanks 20 may be positioned on a crossbar 14. More particularly, in some embodiments, the crossbar 14 may run horizontally through the water tank 20. In some embodiments, the water tank 20 may be rotatably connected to the crossbar 14, such that the crossbar will serve as an axis of rotation. In other embodiments, the crossbar 14, itself, may be configured to rotate about its longitudinal axis. Although the embodiment illustrated in FIG. 3 has a single water tank 20 positioned on crossbar 14, other embodiments of the play unit 10 described herein may contain a plurality of water tanks positioned on a single crossbar.

The water tank 20 comprises a first end 21 and a second end 22. The first end 21 of the water tank comprises one or more openings 23. The one or more openings 23 may be sized and configured to prevent outside objects from entering the interior of the water tank 20. For example, in the illustrated embodiment, the one or more openings 23 comprise a single slit-like opening. The width of the slit-like opening may be less than 5 inches, alternatively less than 4 inches, alternatively less than 3 inches. In other, non-illustrated embodiments, the one or more openings 23 may have a number of different configurations and sizes. For example, in some embodiments, the one or more openings may comprise an array of small openings, similar to those found in a watering can or a shower head. In some embodiments, the one or more openings 23 may also comprise a screen or mesh structure positioned across the opening, which prevents objects from entering the interior of the water tank 20.

In some embodiments, the first end 21 of the water tank may also comprise a closure, or cover, for the one or more openings 23. For instance, the embodiment illustrated in FIG. 5 comprises a cover 24. The cover 24 may be attached to the first end 21 of the water tank through a hinge, such that the cover moves between a position in which it covers the one or more openings 23 (see, e.g. the left image in FIG. 5) and a position in which the one or more openings are exposed (see, e.g., the right image in FIG. 5).

The second end 22 of the water tank may be configured to have a greater weight than the first end 21 of the tank. For example, in some embodiments, the second end 22 of the water tank may comprise one or more solid regions, contain one or more weights, or a combination thereof. The greater weight of the second end 22 biases the water tank 20 into a first position, in which the first end 21 of the tank is positioned above the second end 22 of the tank. In some embodiments, the first end of the tank 21 may be positioned angularly above, as opposed to directly above, the second end of the tank 22. For instance, in the illustrated embodiment, when the tank is empty the first end 21 may be positioned above the second end 22 at an angle between about 50 degrees and about 85 degrees, alternatively between about 55 degrees and about 85 degrees, alternatively between about 55 degrees and about 80 degrees, alternatively between about 60 degrees and about 85 degrees.

Although the water tank 20 of the illustrated embodiment has a substantially triangular shape, the water tank may take on any of a number of different shapes. For instance, in some embodiments, the shape of the water tank 20 may be configured to fit a desired play theme.

Embodiments of the play unit 10 also comprise a water transport system 30. The water transport system 30 is configured to transport water from a water supply (such as a municipal water supply) to the water tank 20. In some embodiments, such as the illustrated embodiment, the water transport system 30 may be concealed within other elements of the play unit 10. For instance, the water transport system 30 may comprise piping that runs through at least one, and optionally both, of the first and second support posts 11, 12. In some embodiments, the water transport system 30 may be connected to a water supply through a connection located below the play surface.

The water transport system 30 may also comprise piping that runs at least partially, and optionally entirely, through the crossbar 14. For instance, the crossbar 14 may comprise one or more nozzles or manifolds through which water may be delivered from the water transport system 30 directly to the interior of the water tank 20. In some embodiments, therefore, the flow of water into the water tank 20 during filling may be completely concealed. In those embodiments where the play unit 10 comprises a plurality of crossbars 14, the water transport system 30 may be configured to supply water through each of the plurality of crossbars 14.

Embodiments of the play unit 10 may also comprise one or more deflectors 40. For instance, a deflector 40 may be positioned below the water tank 20. In some embodiments, the deflector 40 may be supported by a lower crossbar 15. In the illustrated embodiment, for example, a lower crossbar 15 spans between the first and second support posts 11, 12 below the crossbar 14 that supports the water tank 20. The lower crossbar 15 may have a first end that is connected to an upper portion of the first support post 11 and a second end that is connected to an upper portion of the second support post 12. In some embodiments, the lower crossbar 15 may be rotatably connected to the first and second support posts 11, 12, the deflector 40 may be rotatably connected to the lower crossbar 15, or a combination thereof. In other, nonillustrated embodiments, the deflector 40 may not be mounted on a crossbar 15 but rather may itself be connected to the first and second support posts 11, 12.

In some embodiments, the water supply system 30 may also be configured to supply water to the lower crossbar 15. For instance, in some embodiments, the lower crossbar 15 may comprise one or more openings or nozzles through which water may flow. For example, in addition to supporting a deflector 40, the lower crossbar 15 may provide any of a variety of water effects, such as a rain curtain. Similarly, in those embodiments where the deflector 40 is not mounted on a crossbar 15 but rather itself connected to the first and second support posts 11, 12, the water supply system may be configured to supply water to the deflector itself 40 to provide any of a variety of additional water effects, such as a rain curtain.

The deflector 40 may be positioned so that water flowing out of the water tank 20 contacts a surface 41 of the deflector 40 on its way toward the play surface. In some embodiments, for example, the deflector 40 may be angled so as to direct the water flowing out of the water tank 20 in a particular direction. For instance, in the embodiment illustrated in FIG. 3, the deflector 40 is configured to direct the water toward the front of the play unit 10. In other embodiments, the deflector 40 may be configured to direct the water toward the rear of the play unit 10 (e.g. its position on the play unit may be reversed). The angle of the deflector 40 (and hence the angle at which the water flows off of the deflector) may be varied and selected to provide a particular splash effect.

The surface 41 of the deflector 40 may also have one or more features configured to manipulate the water so as to cause the water to flow off of the deflector 40 in a particular manner, thereby providing a unique splash effect. For instance, the deflector 40 may comprise a concave surface 41, as shown in the illustrated embodiment, or a surface comprising concave elements. In other embodiments, the deflector 40 may comprise a convex surface 41 or a surface comprising convex elements. In other embodiments, the surface 41 of the deflector 40 may comprise one or more upward protrusions, e.g., teeth or bumps, around which the water flows (such teeth may also be provided in combination with concave or convex surface features).

In some embodiments, the flow of water onto the deflector 40 may cause the deflector to rotate to provide particular splash effects. For instance, in some embodiments, the deflector may comprise one or more wheels over which water flows. In other embodiments, the deflector 40 may comprise one or more orifices that, when filled with water, cause the deflector to tilt about the crossbar 15 (or the crossbar to rotate about the support posts 11, 12 causing the deflector to tilt) so as to provide a second, delayed splash effect. The variety of splash effects that can be achieved by the incorporation of different deflectors 40 is almost limitless.

In some embodiments, the play unit 10 may be configured to include one or more additional water spray effects. For instance, in the illustrated embodiment, each of the first and second support posts 11, 12 comprises a water spray nozzle 16 extending toward the front of the play unit. The type and position of these additional water spray effects may be varied to provide a desired play experience.

Figure 4:
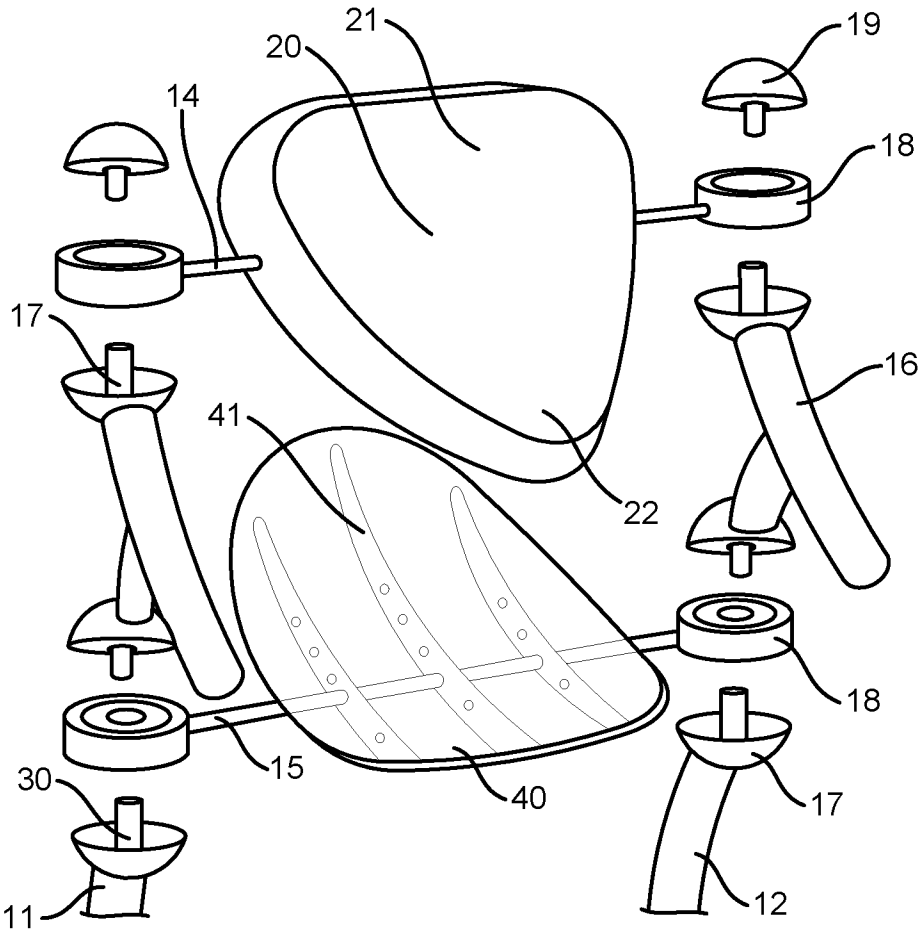
FIG. 4 is an exploded front, left perspective view of an upper portion of the water effect play unit shown in FIG. 3.

In some embodiments, the play unit 10 may be configured so that the types of water effects, as well as the positions of the various water effects, may be interchangeable. For example, in the embodiment illustrated in FIG. 4, the first and second support posts 11, 12 may each comprise a standardized joint 17, such as a stab fitting, to which a variety of water effect elements may be attached. As shown in the illustrated embodiment, crossbars 14, 15 may comprise feed through joints 18 and an intermediate connecting element—in the illustrated embodiment an element comprising an additional water spray nozzle 16, although a variety of connecting elements may be used in its place—may span between and separate the two feed through joints. At the very top of the support posts 11, 12 may be positioned a joint cap 19. In some embodiments, the joint cap 19 may also comprise a water nozzle or other water spray effect. Using this arrangement, support posts 11, 12, once installed may be converted into a variety of different play units 10 simply by interchanging the water spray elements attached to the standardized joint. This arrangement may also simplify repair of the play unit 10, since a non-functioning element may easily be removed and replaced.

The play unit 10 may be configured so that the water tank 20 is in a first position while it fills with water until, upon reaching an activating volume of water inside the tank, the tank rotates or flips into a second position, dumping the water contained therein downward through the one or more openings 23. In some embodiments, a relatively large movement of the water tank 20 between the first and second positions may be desirable, as it will be eye-catching to children and increase the enjoyment of the play unit 10. In other words, it may be desirable that the water tank 20 not merely move from a position in which the first end 21 is located slightly above horizontal to a position in which the first end 21 is located slightly below horizontal, but rather that the tank rotate across a relatively large arc when an activating volume is reached. For instance, in some embodiments, upon reaching an activating volume the water tank 20 will rotate at least 35 degrees, alternatively at least 45 degrees, alternatively at least 55 degrees.

Depending on the direction in which the water tank 20 is positioned, the water tank may be configured to flip toward the front of the play unit 10 or toward the rear of the play unit. As previously described, a deflector 40 may also be used to direct water toward the front of the play unit 10 or toward the rear of the play unit. Therefore, different effects can be provided by altering the directions of the water tanks 20 and deflectors 40 (e.g. a water tank can flip toward the rear of the play unit but the water can be directed toward the front of the play unit by a deflector; a water tank can flip toward the front of the play unit and the water can be directed toward the front of the play unit by a deflector; etc.).

In some embodiments, the water tank 20 may rotate about the crossbar 14. In other embodiments, the tank 20 may be fixed to the crossbar 14 and the crossbar may rotate about the support posts 11, 12. In yet other embodiments, rotation of the water tank 20 between the first and second positions may occur through a combination of these processes.

Figure 5:
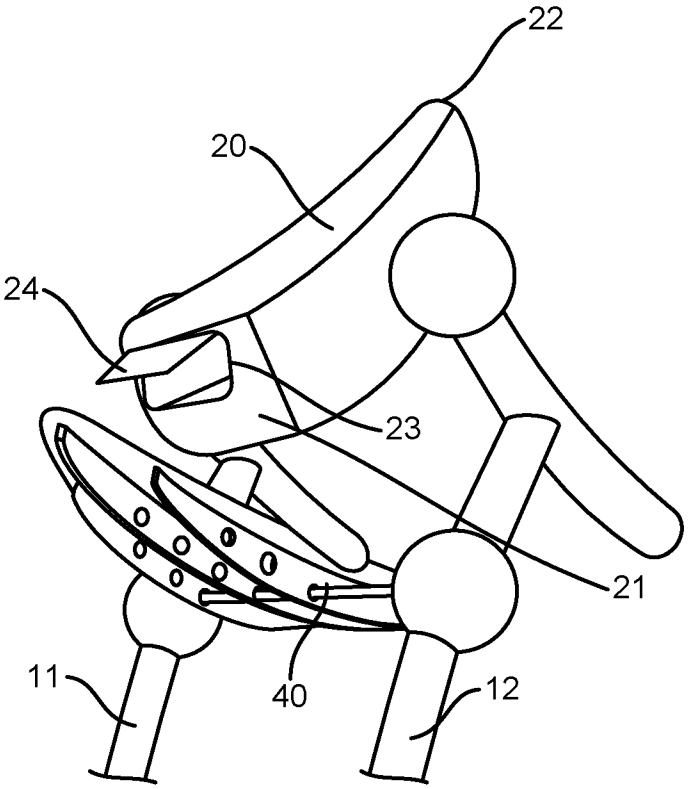
FIG. 5 is a front, right perspective view of an upper portion of the water effect play unit shown in FIG. 3, showing the water tank in each of its first and second positions.
Figure 5:
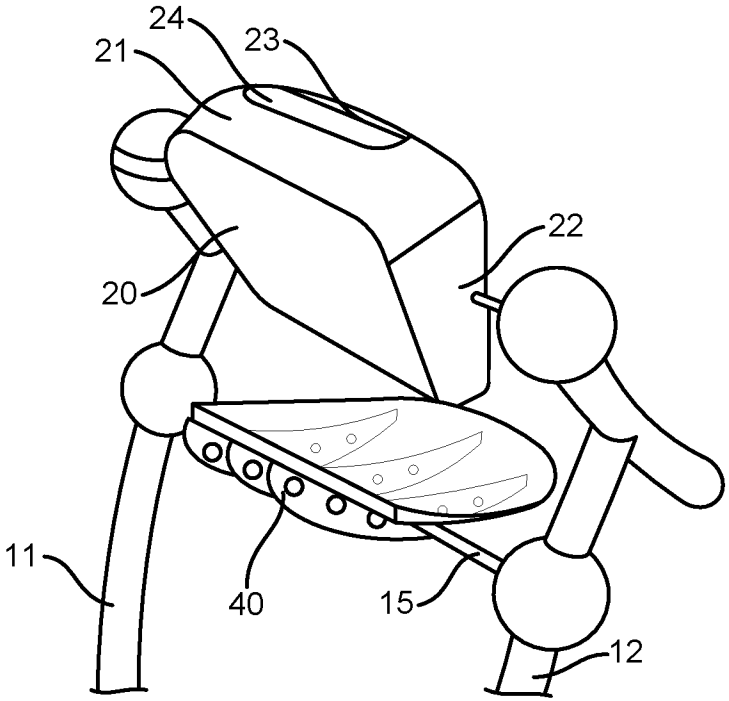

Rotation of an embodiment of a water tank 20 between a first position and a second position is illustrated for example in FIG. 5. In the illustrated embodiment, cover 24 is caused by gravity to move between a closed position (when the water tank 20 is in a first position) and an open position (when the water tank is in a second position). The flow of water through the one or more openings 23 may also cause the cover 24 to open. In some embodiments, the cover 24 may also be used to direct the flow of water from the one or more openings 23 in a particular direction.

Once the contents of the water tank 20 have been emptied, the weight of the second end 22 of the tank will cause the tank to rotate, or flip, back into the first position, whereupon it will begin to fill again.

In some embodiments, the play unit 10 may be modular. For instance, in some embodiments, a number of play units 10 utilizing the same basic sets of components may be linked together, such that certain components are shared by adjacent play units 10. In some embodiments, for example, a play structure 100 may comprise a first play unit 10 and a second play unit 110 linked together. The second play unit 110 may comprise a third support post 111 and a second crossbar 114. The third support post 113 may be substantially identical to the first and second support posts 11, 12. Like the first and second support posts 11, 12, the third support post 111 may have a lower portion 13 configured to be mounted to the play surface. The second crossbar 114 may be substantially identical to crossbar 14. The second crossbar 114 may span between the second support post 12 and the third support post 113. For instance, the second crossbar 114 may have a first end connected to an upper portion of the second support post 12 and a second end connected to an upper portion of the third support post 113.

The second play unit 110 may also comprise one or more water tanks 120 positioned on and supported by the second crossbar 114, as well as a water transport system 130 configured to transport water into the one or more water tanks.

By providing modular play units 10 that may be assembled together as described above, a number of play units 10, 110 may be linked together to form a play structure 100. Each of the support posts 11, 12 may be configured to support a first crossbar 14 on one side of the support post and a second crossbar 114 on the opposite side of the support post. Accordingly, play structures 100 assembled using embodiments of the modular play units 10 minimize the number of support posts 11, 12 required. Additionally, the same set of components may be used to prepare play structures 100 of varying sizes and shapes, minimizing the manufacturing costs while allowing for the construction and installation of customized play structures.

For instance, in some embodiments, a third play unit 210 may be linked to the second play unit 110 in the manner described above. The third play unit 210 may comprise an additional support post 211, an additional crossbar 214, one or more additional water tanks 220, and a water transport system 230 configured to fill the one or more additional water tanks. Similarly, a fourth play unit 310 may be linked to the third play unit 210 in the manner described above. The fourth play unit 310 may comprise an additional support post 311, an additional crossbar 314, one or more additional water tanks 320, and a water transport system 330 configured to fill the one or more additional water tanks. Although not illustrated, additional (e.g. fifth, sixth, seventh, etc.) play units may also be linked in order to form larger play structures 100.

In some embodiments, one or more of the linked play units 10, 110, etc. may comprise deflectors 40, 140, 240, 340. In some embodiments, for example, each deflector 40, 140, 240, 340, etc. may be mounted on a respective lower crossbar 15, 115, 215, 315, etc. as described herein.

To facilitate the construction of play structures 100 through the modular connection of a plurality of play units 10, it is important the play units 10 and the components thereof are easy to install and adaptable to at least a small degree of misalignment. For instance, the connection between a crossbar 14 and the support posts 11, 12, etc. may be configured to be water tight even where one or more of crossbars 14, 114 may not connect to a support post 11, 12, etc. in perfect alignment. For instance, when multiple play units 10 are connected modularly, there may be some differences in the exact locations at which each crossbar 14, 114, etc. intersects a support post 11, 12, etc. and/or in the exact angles at which each crossbar intersects a support post. Accordingly, the support posts 11, 12, etc. may comprise a crossbar connection element that is configured to accept and secure a crossbar 14, 114, etc. to form a water-tight connection despite a degree of imprecision as to the exact location (vertical and/or horizontal) at which the crossbar is connected and/or the exact angle of the crossbar at the point of connection.

The water transport systems 30, 130, etc. of the assembled play units 10, 110, etc. may be linked together so that only one connection with a water supply is necessary to supply water to each of the water tanks 20, 120, etc. In some embodiments, each of the water transport systems 30, 130, etc. may be linked such that water flows to each play unit individually, e.g. through an underground linkage. In other embodiments, each of the water transport systems 30, 130, etc. may be linked within the play structure 100 itself, such that a single flow of water extends to the water tanks 20, 120, etc. of more than one play unit 10, 110, etc.

Figure 6:
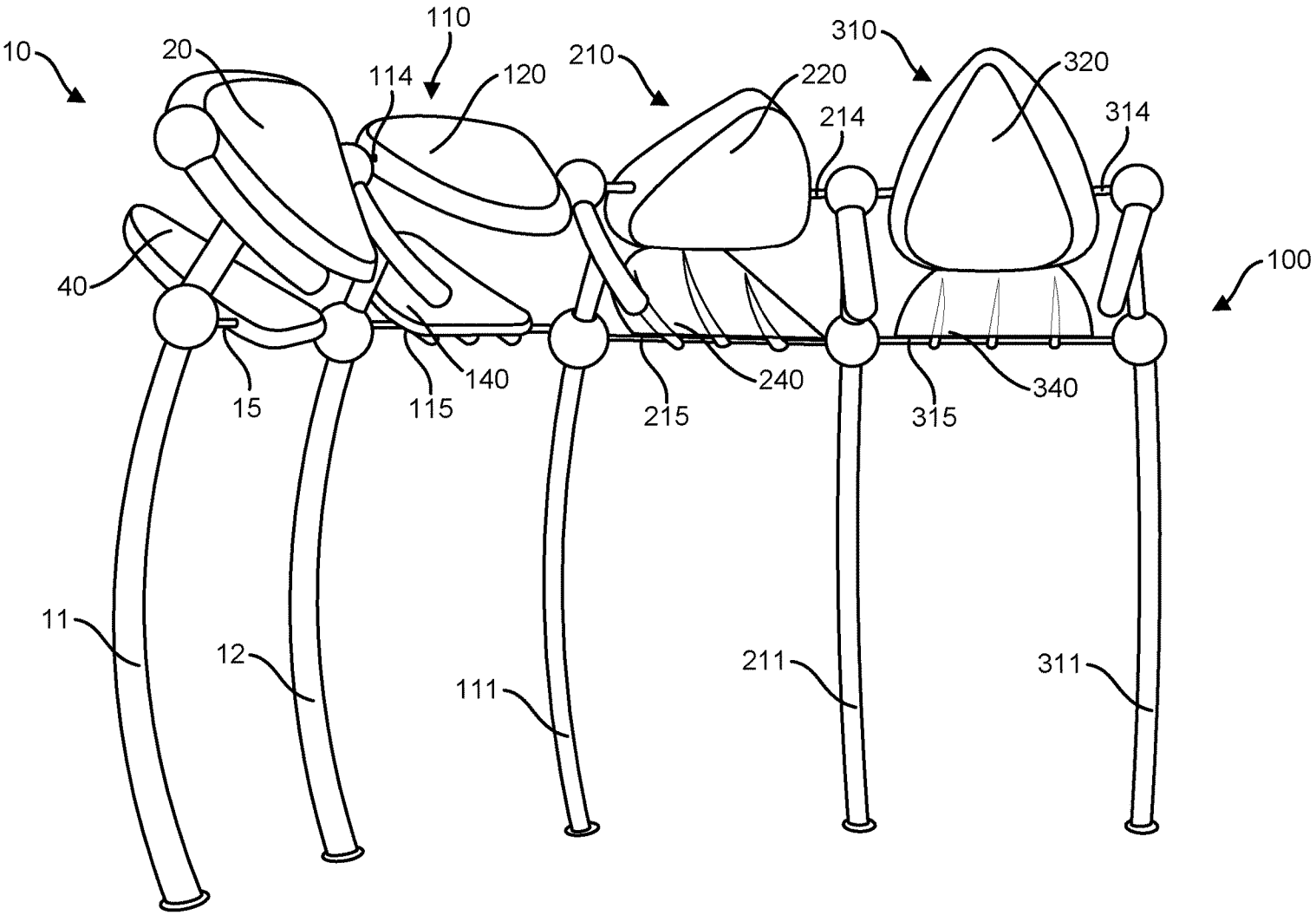
FIG. 6 is a perspective view of a water effect play structure comprising four modular units, such as those shown in FIG. 3, assembled in series, in this case to form a circular arc.

A play structure 100 may be prepared by linking a plurality of play units 10, 110, etc. in series. For example, in some embodiments, the play structure 100 may comprise a row of play units 10, 110, etc, linked side-by-side. The play units 10, 110, etc. may be arranged to form a straight line, a zig-zag, a circular arc, etc. For instance, an embodiment of a play structure 100 comprising four play units 10, 110, 210, 310 arranged in a circular arc is shown in FIG. 6.

Figure 7:
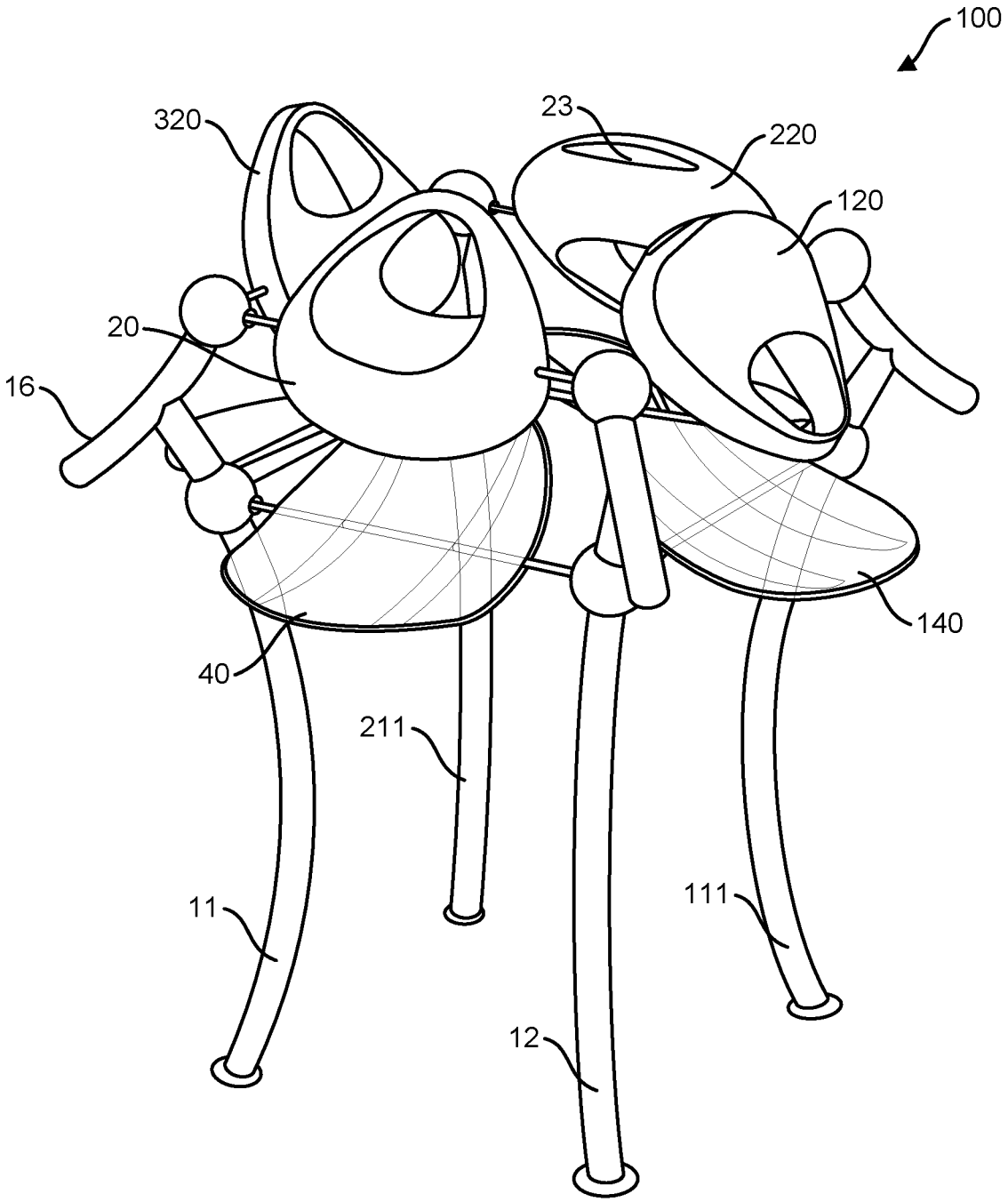
FIG. 7 is a perspective view of a water effect play structure comprising four modular units, such as those shown in FIG. 3, assembled in a closed circuit to form a polygon, in this case a square.

A play structure 100 may also be prepared by linking a plurality of play units 10, 110, etc. in a closed circuit. In some embodiments, the closed circuit of play units 10, 110, etc. may form a polygon. For instance, three play units 10, 110, 210 may be assembled so that each play unit 10, 110, 210 is connected to two adjacent units to form a triangle. Or, as shown in FIG. 7, four play units 10, 110, 210, 310 may be assembled so that each lay unit is connected to two adjacent units to form a square. In other embodiments, the closed circuit may form a circle (such as where the crossbars 14, 114, etc. of the various play units 10, 110, etc. are curved). Note that where the play units 10, 110, etc. are assembled in a closed circuit, the number of support posts 11, 12, 111, etc. required may be further minimized. For instance, the play structure 100 shown in FIG. 7 contains only four support posts 11, 12, 111, 211.

Embodiments of the play structure 100 described herein may provide a number of unique play opportunities. For example, in some embodiments, one or more of the plurality of water tanks 20, 120, etc. may be configured to release the water contained therein, i.e. tip, at different times. In some embodiments, the plurality of water tanks 20, 120, etc. may be configured to tip at random or in a substantially random order. This may provide a unique play experience, as children will not know which water tank 20, 120, etc. is about to release its water, leading children to move between the various play units 10, 110, etc. In addition to keeping a child's attention for a longer duration, embodiments of the play structure 100 described herein may therefore also lead to a more active play experience.

Another additional benefit is that, in some embodiments, there may be a near constant movement of tanks 20, 120, etc., which may be visually eye-catching and draw children to the structure 100. For instance, in some embodiments, one or more of the plurality of water tanks may tip within every 60 second interval, alternatively within every 45 second interval, alternatively within every 30 second interval, alternatively within every 20 second interval, alternatively within every 15 second interval.

Embodiments of the play structures 100 described herein may be configured so that one or more of a plurality of water tanks 20, 120, etc. release the water contained therein, i.e. tip, at different times in a number of different ways.

In some embodiments, the water tanks 20, 120, etc. may be configured to fill at different rates, i.e., the water transport system 30, 130, etc. may be configured to supply water to the water tanks 20, 120, etc. at different rates. For instance, the water supply systems 30, 130, etc. for the different play units 10, 110, etc. may comprise piping having different diameters, the water supply systems for the different play units may comprise different nozzles or manifolds, the water supply systems may be configured to pump the water to the different play units at different pressures, the water supply systems for the different play units may comprise one or more obstructions or flow paths of differing lengths, or any combination of the above. In some embodiments, a pump may be configured and programmed to provide water to the plurality of water tanks 20, 120, etc. at random or substantially random rates.

In some embodiments, the water tanks 20, 120, etc. may have different activation volumes. For example, the water tanks 20, 120, etc. for the different play units 10, 110, etc. may have different interior volumes, the water tanks for the different play units may have different geometries, the water tanks for the different play units may have different weights incorporated into the second end, or any combination thereof. In some embodiments, both the water transport system 30, 130, etc. may be configured to supply water to the water tanks 20, 120, etc. for the different play units 10, 110, etc. at different rates and the water tanks for the different play units may have different activation volumes.

Embodiments of the play structures 100 described herein may also be configured so that one or more of the plurality of water tanks 20, 120, etc. release the water contained therein so as to provide splash effects in a variety of different directions. For instance, where the play structure 100 comprises a plurality of play units 10, 110, etc. in series, at least one of the plurality of water tanks 20, 120, etc. may be configured to provide a splash effect to the front of the structure 100 and at least one of the plurality of water tanks may be configured to provide a splash effect to the rear of the structure. In some embodiments, for instance, adjacent play units 10, 110, etc. may provide splash effects in alternating directions.

Using embodiments of the present disclosure, providing splash effects in multiple directions may be achieved in a number of manners. For example, the water tanks 20, 120, etc. may be positioned so as to tip in different directions, e.g. water tank 120 may be positioned on the crossbar 114 or the crossbar 114 may be connected to the support posts 12, 111 so that the water tank 120 faces the opposite direction from water tank 20. Alternatively, one or more of the deflectors 40, 140, etc. may be positioned so as to cause a splash effect to occur in a different direction. For example, deflector 40 may be positioned to cause a splash effect toward the front of a play structure 100 and adjacent deflector 140 may be positioned to cause a splash effect toward the rear of a play structure. In other embodiments, both the water tanks 20, 120, etc. may be positioned to tip in different directions and deflectors 40, 140, etc. may be positioned to cause the water to flow in different directions.

In the embodiment illustrated in FIG. 7, for example, the play structure 100 is configured so that each of the splash effects occurs to the exterior of the polygonal structure. This may have the additional benefit of creating a dry zone at the center of the structure 100. Children and adults may enjoy congregating in the dry zone and enjoying the entertainment and cooling effects of the flowing water without getting wet. In the illustrated embodiment, each of the water tanks 20, 120, 220, 320 is configured to tip inward toward the center of the play structure 100, but the released water is manipulated by the deflectors 40, 140, 240, 340 so as to flow toward the exterior of the structure. This may provide an enjoyable visual effect for children and adults located in the central dry zone. Namely, when the deflectors 40, 140 etc. are transparent or translucent, it will appear that water being released from the tanks 20, 120, etc. is falling directly onto those located in the dry zone. Other configurations are also contemplated however. In the illustrated embodiment, each of the additional water spray effects 16 is also positioned so as to spray toward the exterior of the structure. In other, non-illustrated embodiments, a plurality of the splash effects may be configured to occur toward the interior of a polygonal structure 100, thereby causing a central soak zone.

Embodiments of the play structures 100 described herein may also be configured so that one or more of the play units 10, 110, etc. provide different splash effects. For instance, the deflectors 40, 140, etc. associated with the plurality of water tanks 20, 120, etc. may differ from one another. By providing a play structure 100 with different types of deflectors 40, 140, one can provide a variety of unique splash play opportunities within a single structure 100. It may also provide a preserved element of surprise, as children may forget which play unit 10, 110 provides which unique splash effect especially when the play units 10, 110, etc. are configured in a closed circuit.

Figure 8A:
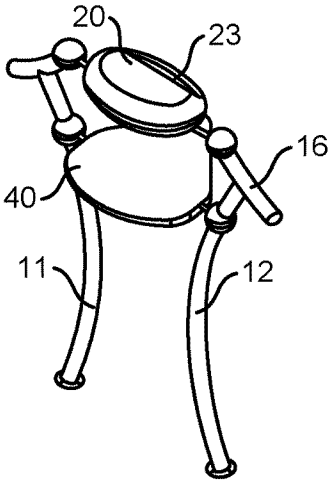
FIG. 8A is a top perspective view of an embodiment of a water effect play unit having the first and second support posts in a first configuration.
Figure 8B:
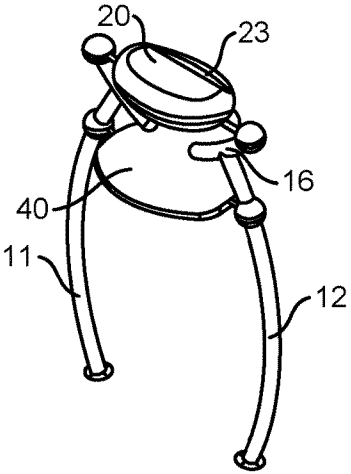
FIG. 8B is a top perspective view of an embodiment of a water effect play unit having the first and second support posts in a second configuration.
Figure 8C:
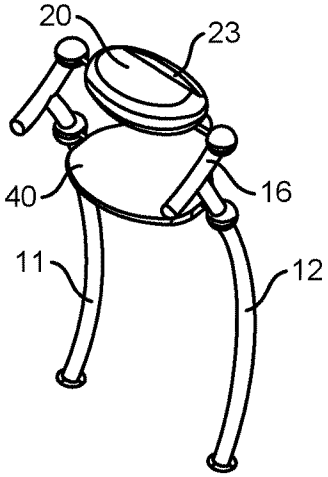
FIG. 8C is a top perspective view of an embodiment of a water effect play unit having the first and second support posts in a third configuration.
Figure 8D:
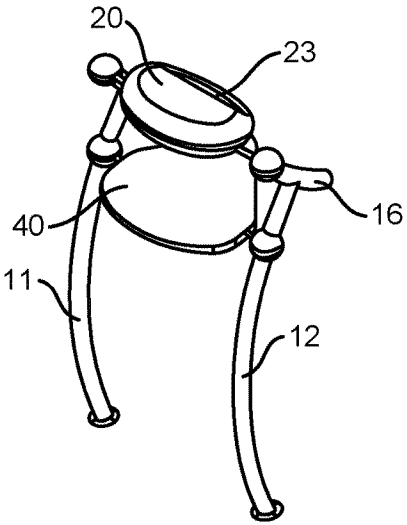
FIG. 8D is a top perspective view of an embodiment of a water effect play unit having the first and second support posts in a fourth configuration.

In some embodiments, the support posts 11, 12 for each play unit 10 may also be configured so that they can be mounted in a variety of configurations, providing an additional degree of flexibility for the design of unique and customized play structures 100. For instance, the support posts 11, 12 of the illustrated embodiments may be mounted in at least four different ways, as illustrated in FIG. 8: (i) the support posts may be mounted so as to curve outward toward the sides of the play unit 10, as illustrated in FIG. 8A; (ii) the support posts may be mounted so as to curve inward away from the sides of the play unit, as illustrated in FIG. 8B; (iii) the support posts may be mounted so as to curve toward the front of the play unit, as illustrated in FIG. 8C; and/or (iv) the support posts may be mounted so as to curve toward the rear of the play unit, as illustrated in FIG. 8D. This flexibility allows for the construction of play structures 100 having a variety of unique shapes and designs.

In some embodiments, each of water tanks 20, 120, etc. may be configured to hold between about 5 and about 30 gallons of water, alternatively between about 5 and about 20 gallons, alternatively between about 8 and about 18 gallons, alternatively between about 10 and about 15 gallons. In some embodiments, the different water tanks 20, 120, etc. in a play structure 100 may hold different volumes of water, such that the splash effects from different play units 10, 110, etc. have varying levels of magnitude.

It can be seen that the described embodiments provide unique and novel play units 10 and structures 100 that have a number of advantages over those in the art. While there is shown and described herein certain specific structures embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed:

1. A water effect play structure comprising:

a. a base comprising one or more support posts having a first end mounted to a play surface;

b. a plurality of water tanks, the plurality of water tanks being supported by the base at an elevation above the play surface; and c. a water transport system configured to transport water from a water supply to the plurality of water tanks;

wherein each of the plurality of water tanks is configured to fill with water and then release the water contained therein such that the water falls toward the play surface;

wherein the play structure is configured so that the plurality of water tanks release the water contained therein at different times; and wherein the water transport system comprises a component that extends into an interior of at least one of the plurality of water tanks, such that the interior of the water tank is not outside-accessible during filling;

wherein the at least one of the plurality of water tanks comprises a first end and a second end, the first end comprising one or more openings;

the water tank is configured to rotate between a first position in which the first end faces substantially upward and a second position in which the first end faces substantially downward, whereby in the first position the tank fills with water and in the second position the tank releases water through the one or more openings;

the second end of the water tank has a greater weight than the first end, such that when the tank is empty it is biased into the first position; and the first end of the water tank comprises a cover for the one or more openings, the cover being configured to open when the tank is in the second position and close when the tank is in the first position.

2. The play structure of claim 1, wherein the first end of the water tank is positioned angularly above the second end, such that the water tank rotates from the first position to the second position upon being filled with an activating volume of water.

3. The play structure of claim 2, wherein the activating volume for a first water tank is substantially different from the activating volume for a second water tank.

4. The play structure of claim 2, wherein a rate at which a first water tank fills is substantially different from a rate at which a second water tank fills.

5. The play structure of claim 1, further comprising a plurality of deflectors, each deflector being positioned below one or more of the plurality of water tanks such that the water hits a surface of the deflector as it falls toward the play surface.

6. The play structure of claim 5, wherein a surface geometry of a first deflector is different from a surface geometry of a second deflector, such that a flow of water from the first deflector differs from a flow of water from the second deflector.

7. The play structure of claim 1, comprising a plurality of water tanks arranged in a closed circuit.

8. The play structure of claim 7, wherein the closed circuit forms a polygon.

9. The play structure of claim 1, comprising a plurality of water tanks arranged in series.

10. A water effect play unit comprising:

a. first and second support posts, each of the first and second support posts having a lower portion configured to be mounted to a play surface;

b. a crossbar having a first end connected to an upper portion of the first support post and a second end connected to an upper portion of the second support post;

c. a water tank positioned on the crossbar, such that the crossbar runs through the water tank; and d. a water transport system configured to transport water to the water tank;

wherein the water tank comprises a first end having one or more openings and a second end, wherein the water tank is biased into a filling position in which the first end of the water tank is located above the second end; and wherein upon filling of the water tank with an activating volume of water, the tank rotates from the filling position to a releasing position in which the first end of the tank is located below the second end, such that water is released from the tank through the one or more openings;

wherein the water tank comprises a closure configured to prevent access to the one or more openings when the tank is in the filling position; and wherein the water transport system is configured to supply water into an interior of the water tank through at least a portion of the crossbar, such that during filling the flow of water into the water tank is concealed.

11. The play unit of claim 10, further comprising a deflector positioned below the water tank.

12. The play unit of claim 10, further comprising e. a third support post having a lower portion configured to be mounted to the play surface;

f. a second crossbar, the second crossbar having a first end connected to an upper portion of the second support post and a second end connected to an upper portion of the third support post; and g. a second water tank positioned on the second crossbar.

13. The play unit of claim 10, wherein in the filling position the first end of the water tank is positioned above the second end of the water tank at an angle between 50 degrees and 85 degrees.

14. A water effect play structure comprising:

a. a base comprising one or more support posts having a first end mounted to a play surface;

b. a plurality of water tanks, the plurality of water tanks being supported by the base at an elevation above the play surface; and c. a water transport system configured to transport water from a water supply to the plurality of water tanks;

wherein each water tank comprises a first end having one or more openings and a second end;

each water tank is biased into a filling position in which the first end of the water tank is located above the second end; and upon filling of each water tank with an activating volume of water, the tank rotates from the filling position to a releasing position in which the first end of the tank is located below the second end, such that water is released from the tank through the one or more openings;

wherein the first end of each water tank comprises a cover for the one or more openings, the cover being configured to open when the tank is in the releasing position and close when the tank is in the filling position.

15. The play structure of claim 14, further comprising a plurality of deflectors, each deflector being positioned below a water tank such that the water hits a surface of the deflector when it is released from the tank.

16. The play structure of claim 15, wherein a surface geometry of a first deflector is different from a surface geometry of a second deflector, such that a flow of water from the first deflector differs from a flow of water from the second deflector.

17. A water effect play structure comprising:

a. a base comprising one or more support posts having a first end configured to be mounted to a play surface;

b. a water tank supported by the base at an elevation above the play surface; and c. a water transport system configured to transport water from a water supply to the water tank;

wherein the water tank is configured to fill with water and then release the water contained therein such that the water falls toward the play surface, the water tank has a first end and a second end, the first end comprising an opening, the water tank is configured to rotate between a filling position in which the first end is positioned above the second end and a releasing position in which the first end is positioned below the second end, and the second end of the water tank has a greater weight than the first end, such that when the water tank is empty it is biased into the filling position;

wherein the first end of the water tank comprises a cover for the opening, the cover being configured to open when the tank is in the releasing position and close when the tank is in the filling position, and the water transport system comprises a component that extends into an interior of the water tank, such that the interior of the water tank is fully enclosed during filling.

18. A water effect play structure comprising:

a. a base comprising one or more support posts having a first end mounted to a play surface;

b. a water tank supported by the base at an elevation above the play surface; and c. a water transport system configured to transport water from a water supply to the water tank;

wherein the water tank comprises a first end having one or more openings and a second end;

the water tank is biased into a filling position in which the first end of the water tank is located above the second end; and upon filling of the water tank with an activating volume of water, the tank rotates from the filling position to a releasing position in which the first end of the tank is located below the second end, such that water is released from the tank through the one or more openings;

wherein the first end of the water tank comprises a cover for the one or more openings, the cover being configured to open when the tank is in the releasing position and close when the tank is in the filling position.

* * * * *